US011529641B2

(12) United States Patent
Snyder et al.

(10) Patent No.: US 11,529,641 B2
(45) Date of Patent: Dec. 20, 2022

(54) CAP ASSEMBLY

(71) Applicant: SAINT-GOBAIN PERFORMANCE PLASTICS CORPORATION, Solon, OH (US)

(72) Inventors: Mitchell L. Snyder, Hope, MI (US); Jason Osentoski, Gladwin, MI (US); Gerald Mark Pennington, Wesley Chapel, FL (US)

(73) Assignee: SAINT-GOBAIN PERFORMANCE PLASTICS CORPORATION, Solon, OH (US)

( * ) Notice: Subject to any disclaimer, the term of this patent is extended or adjusted under 35 U.S.C. 154(b) by 0 days.

(21) Appl. No.: 16/227,162

(22) Filed: Dec. 20, 2018

(65) Prior Publication Data

US 2019/0193898 A1 Jun. 27, 2019

Related U.S. Application Data

(60) Provisional application No. 62/610,560, filed on Dec. 27, 2017.

(51) Int. Cl.

| | |
|---|---|
| ***B05B 11/00*** | (2006.01) |
| ***B65D 41/16*** | (2006.01) |
| ***B65D 55/02*** | (2006.01) |
| ***B65D 41/28*** | (2006.01) |
| ***F17C 1/00*** | (2006.01) |
| ***B65D 47/06*** | (2006.01) |

(52) U.S. Cl.

CPC ..... *B05B 11/3049* (2013.01); *B65D 41/16* (2013.01); *B65D 41/28* (2013.01); *B65D 47/06* (2013.01); *B65D 55/024* (2013.01); *F17C 1/00* (2013.01)

(58) Field of Classification Search

CPC ..... B65D 41/16; B65D 47/06; B65D 55/024; B65D 41/28; F17C 1/00; B05B 11/3049

USPC ..... 215/247, 274, 309; 222/321.9, 400.7

See application file for complete search history.

(56) References Cited

U.S. PATENT DOCUMENTS

| | | | | |
|---|---|---|---|---|
| 2,276,421 A * | 3/1942 | Ross | A61M 1/02 | 215/247 |
| 2,744,661 A * | 5/1956 | Davis | B65D 47/06 | 222/189.06 |
| 3,253,728 A | 5/1966 | Putron | | |

(Continued)

FOREIGN PATENT DOCUMENTS

| | | |
|---|---|---|
| CN | 1161020 A | 10/1997 |
| CN | 1175234 A | 3/1998 |

(Continued)

OTHER PUBLICATIONS

International Search Report and Written Opinion for PCT/2018/066728, dated Apr. 17, 2019, 13 pages.

*Primary Examiner* — James N Smalley

(74) *Attorney, Agent, or Firm* — Abel Schillinger, LLP; Chi Suk Kim

(57) ABSTRACT

A cap assembly for closing an opening in a vessel may include a stopper and a rigid cap adapted to fit over the stopper and onto a vessel. The stopper may include a polymer body adapted to fit an opening of the vessel and a tubular portion defining an internal passageway extending through the polymer body. The rigid cap may include a pressure based locking mechanism adapted to engage the vessel under a unidirectional force and a tamper evident feature.

14 Claims, 6 Drawing Sheets

(56) References Cited

U.S. PATENT DOCUMENTS 3,343,699 A * 9/1967 Nicko ..... B67D 1/0829 215/247
3,813,223 A 5/1974 Fleck
4,000,829 A * 1/1977 Johnson, Jr. ..... B65D 47/32 220/265
4,080,989 A 3/1978 Chapelsky et al.
4,387,818 A 6/1983 Conti
4,700,861 A * 10/1987 Neward ..... B67D 3/00 141/46
4,993,573 A * 2/1991 Freidel ..... B01L 3/08 215/276
5,085,332 A * 2/1992 Gettig ..... B65D 51/18 215/249
5,209,362 A * 5/1993 Lutzker ..... B65D 51/145 215/225
5,379,908 A 1/1995 Rohe
5,505,325 A 4/1996 Thompson et al.
5,588,562 A 12/1996 Sander et al.
5,702,019 A * 12/1997 Grimard ..... A61J 1/2096 141/24
5,876,140 A 3/1999 Kuramoto et al.
5,957,314 A * 9/1999 Nishida ..... B65D 45/322 215/249
6,619,495 B1 9/2003 Pares et al.
6,684,814 B1 2/2004 Ver Hage
7,854,104 B2 12/2010 Cronin et al.
7,988,004 B1 8/2011 Marret et al.
2001/0037990 A1* 11/2001 Pous ..... B65D 83/38 215/272
2002/0079280 A1* 6/2002 Neuner ..... B65D 45/322 215/40
2005/0184104 A1* 8/2005 Mutterle ..... B65D 47/18 222/420
2006/0283726 A1 12/2006 McCloud
2007/0278256 A1 12/2007 Law et al.
2007/0289934 A1 12/2007 Gancia
2010/0147899 A1 6/2010 Nardi
2011/0155758 A1 6/2011 Johnson
2011/0303670 A1 12/2011 Baker
2012/0187072 A1* 7/2012 Belle ..... B65D 45/32 215/274
2012/0248057 A1* 10/2012 Bogle ..... B65D 51/002 215/43
2013/0230423 A1* 9/2013 Faneca Llesera ... B05B 11/3047 417/437
2014/0217124 A1* 8/2014 Kim ..... B05B 11/3074 222/321.9

FOREIGN PATENT DOCUMENTS

CN 1263508 A 8/2000
JP 2015224054 A 12/2015
WO 9903747 A1 1/1999
WO 2010065998 A1 6/2010

* cited by examiner

CAP ASSEMBLY

CROSS-REFERENCE TO RELATED APPLICATION(S)

This application claims priority under 35 U.S.C. § 119(e) to U.S. Provisional Application No. 62/610,560, entitled "CAP ASSEMBLY," by Mitchell L. Snyder et al., filed Dec. 27, 2017, which is assigned to the current assignee hereof and is incorporated herein by reference in its entirety.

FIELD OF THE DISCLOSURE

The present disclosure relates to cap assemblies, and more particularly to, pressure based locking cap assemblies for closing an opening in a plastic or glass vessel.

RELATED ART

Cap assemblies can be used to close or seal an opening in vessels, particularly vessels made from plastic or glass. Current designs of cap assemblies have many drawbacks. For example, current designs of cap assemblies may not provide adequate seal integrity. Further, high applied torques are becoming increasingly necessary to provide proper sealing and closure of the opening of the vessel, especially when the fluid in the vessel is under pressure, causing leakage. Further, current designs do not enable complete engagement of the threadings in a cap assembly, leading to the inability to withstand high torque values. For example, during the rapid torqueing of the cap assembly, current designs can have failures such as jumping of the threading and misalignment of the cap assembly with respect to the opening of the vessel. Still further, failures can result from tilting of the cap assembly causing an uneven pressure application about the opening of the vessel.

Further improvements in cap assemblies are needed, particularly in enabling the cap assemblies to withstand high applied torques and achieve substantial seal engagement to the vessel to ensure an adequate seal and minimize leakage and operator error in assembling a seal and retainer within a cap assembly. The following disclosure describes embodiments of a cap assembly which can overcome the disadvantages of the current designs and achieve improved seal engagement resulting in repeatable high performing cap assemblies.

SUMMARY

According to one aspect, a cap assembly for closing an opening in a vessel may include a stopper and a rigid cap adapted to fit over the stopper and onto a vessel. The stopper may include a polymer body adapted to fit an opening of the vessel and a tubular portion defining an internal passageway extending through the polymer body. The rigid cap may include a pressure based locking mechanism adapted to engage the vessel under a unidirectional force and a tamper evident feature.

According to yet another aspect, a method for forming a cap assembly may include forming a stopper and a rigid cap adapted to fit over the stopper and onto a vessel. The stopper may include a polymer body adapted to fit an opening of the vessel and a tubular portion defining an internal passageway extending through the polymer body. The rigid cap may include a pressure based locking mechanism adapted to engage the vessel under a unidirectional force and a tamper evident feature.

BRIEF DESCRIPTION OF THE DRAWINGS

Embodiments are illustrated by way of example and are not limited in the accompanying figures.

Figure 1A:
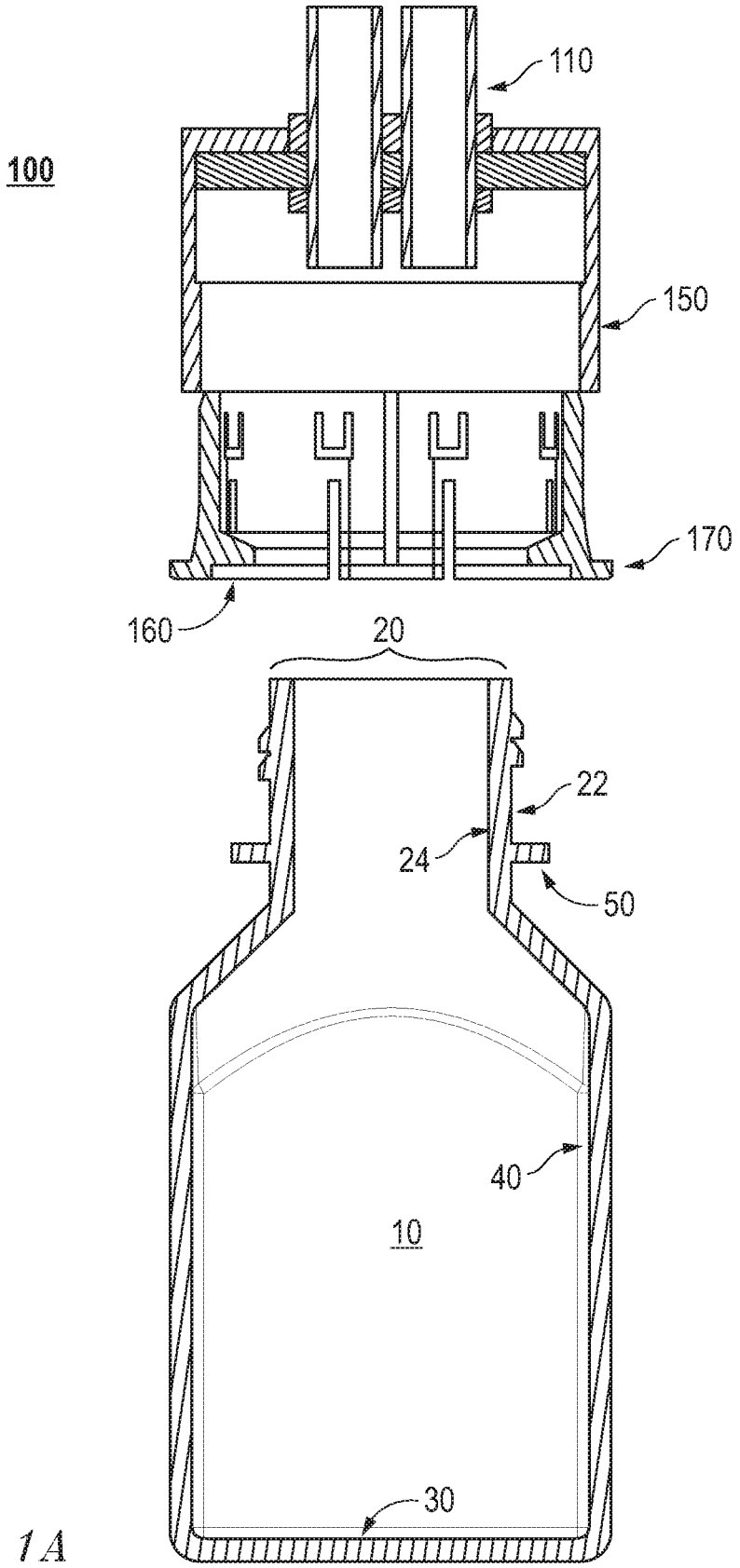
FIG. 1A illustrates a cap assembly and a vessel in a disengaged configuration according to embodiments described herein.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single embodiment is described herein, more than one embodiment may be used in place of a single embodiment. Similarly, where more than one embodiment is described herein, a single embodiment may be substituted for that more than one embodiment.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the vessel sealing arts.

Embodiments described herein are generally directed to a cap assembly adapted to engage a vessel under a particular direct pressure such that the cap assembly achieves a substantial sealing engagement with the vessel. According to certain embodiments, the sealing engagement ensures an adequate sealing pressure and minimizes operator error in assembling a seal and retainer within a cap assembly.

The concepts are better understood in view of the embodiments described below that illustrate and do not limit the scope of the present invention.

Figure 1B:
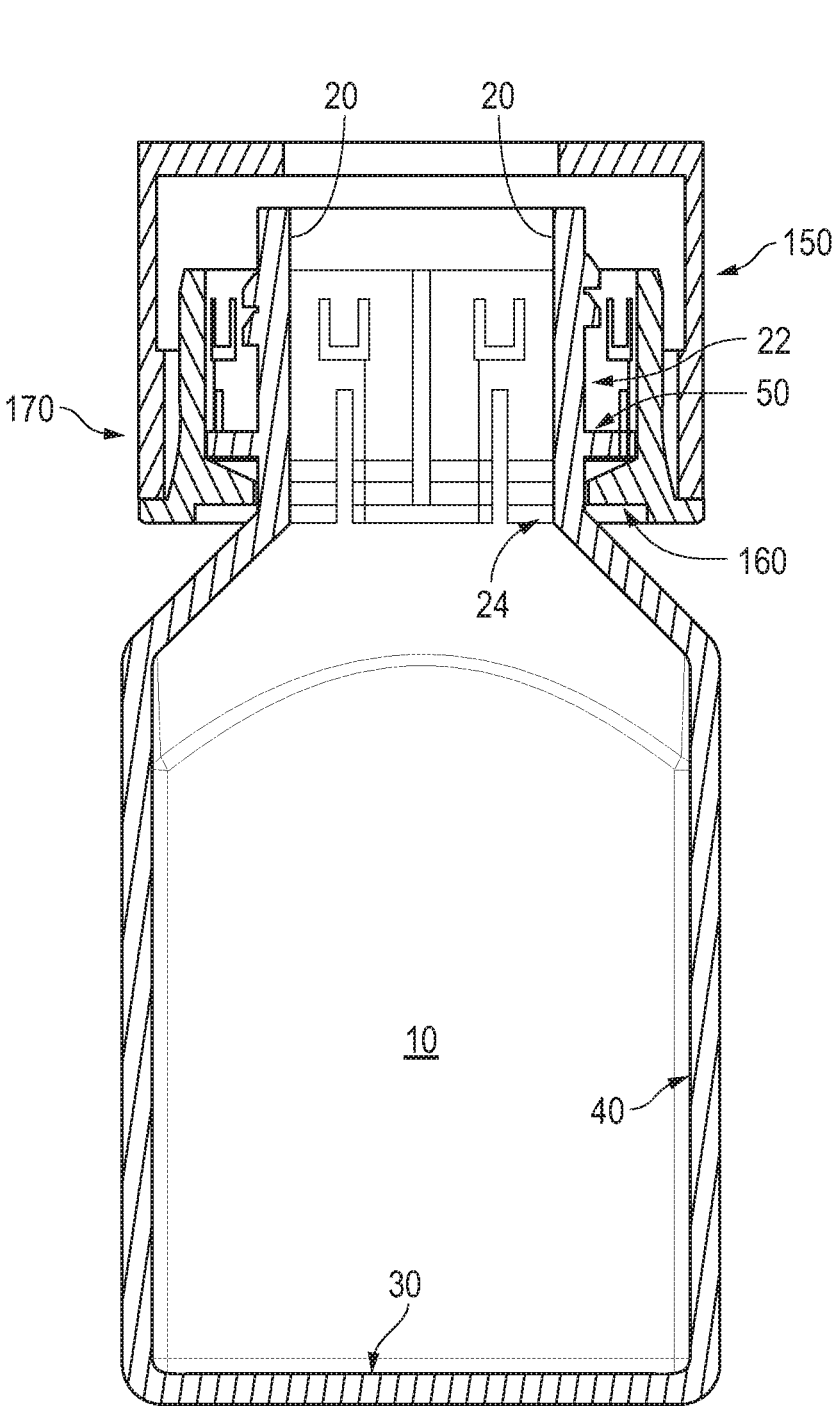
FIG. 1B illustrates a cap assembly and a vessel in a engaged configuration according to embodiments described herein.

FIGS. 1A and 1B include illustrations of a cap assembly 100 for covering, closing and sealing an opening 20 in a vessel 10. FIG. 1A shows the cap assembly 100 in a disengaged configuration where the cap assembly 100 is not installed over (i.e., is separate from) the opening 20 of the vessel 10. FIG. 1B shows the cap assembly 100 in an engaged configuration where the cap assembly 100 is installed over the opening 20 of the vessel 10.

According to particular embodiments and as shown in FIGS. 1A and 1B, the cap assembly 100 may include a rigid cap 150 that may include a pressure based locking (or snap connecting) mechanism 160 and a tamper evident feature 170.

According to a yet other embodiments and as shown in FIGS. 1A and 1B, the vessel 10 may include an opening 20, a bottom 30 opposite of the opening 20 and a sidewall 40 extending from the bottom 30 to the opening 20. The opening 20 may be adapted to accept the cap assembly 100. The opening 20 may have an interior surface 24 and an exterior surface 22.

According to certain embodiments and as shown in FIGS. 1A and 1B, the pressure based locking mechanism 160 may be adapted to engage with the vessel 10 under a direct and generally unidirectional force. In other words, the pressure based locking mechanism 160 may be adapted to engage with the vessel 10 without the application of torque or a twisting mechanism.

According to certain embodiments and as shown in FIGS. 1A and 1B, the pressure based locking mechanism 160 may be adapted to engage with a locking flange 50 on an exterior surface 22 of the opening 20 of the vessel 10. Engagement of the pressure based locking mechanism 160 with the locking flange 50 on the exterior surface 22 of the opening 20 of the vessel 10 secures or locks the rigid cap 150 in place over the opening 20 of the vessel 10.

According to certain embodiments, the pressure based locking mechanism 160 may be adapted to engage with the vessel 10 under a particular direct and generally unidirectional force referred to herein as a engagement locking force. For example, the engagement locking force for the locking mechanism 160 of the cap assembly 100 may be not greater than about 50 lbs, such as, not greater than about 45 lbs or not greater than about 40 lbs or even not greater than about 35 lbs. According to still other embodiments, the engagement locking force for the locking mechanism 160 of the cap assembly 100 may at least about 10 lbs, such as, at least about 15 lbs or at least about 20 lbs or at least about 25 lbs. It will be appreciated that the engagement locking force for the locking mechanism 160 may be within a range between any of the values noted above. It will be further appreciated that the engagement locking force for the locking mechanism 160 may be any value between any of the values noted above.

According to yet other embodiments, the tamper evident feature 170 may be adapted to show evidence of tampering with the cap assembly 100 after initial engagement of the pressure based locking mechanism 160 with the vessel 10. Evidence of tampering may be shown through any alteration in the physical appearance or structure of the tamper evident feature 170 from its original form after engagement of the pressure based locking mechanism 160 with the vessel 10, for example, cracking, breakage, or deformation of the tamper evident feature 170. According to certain embodiments, the tamper evident feature 170 may be configured to show such evidence of tampering upon any attempt to remove the camp that disrupts the seal between the cap assembly 100 and the vessel 10 created after initial engagement of the pressure based locking mechanism 160 with the vessel 10.

According to particular embodiments, the combination of the pressure based locking mechanism 160 and the tamper evident feature 170 may ensure that the cap assembly 100 is utilized as only a single installation or engagement component (i.e. the cap assembly 100 can only be successfully installed on the vessel 10 once). According to still other embodiments, the combination of the pressure based locking mechanism 160 and the tamper evident feature 170 may further ensure and/or guarantee, that once the cap assembly 100 is installed on a vessel 10 as shown in FIG. 1*b*, the newly sealed vessel remains uncontaminated by outside sources after initial engagement of the pressure based locking mechanism 160 with the vessel 10 unless evidenced by tamper evident feature 170.

Figure 2:
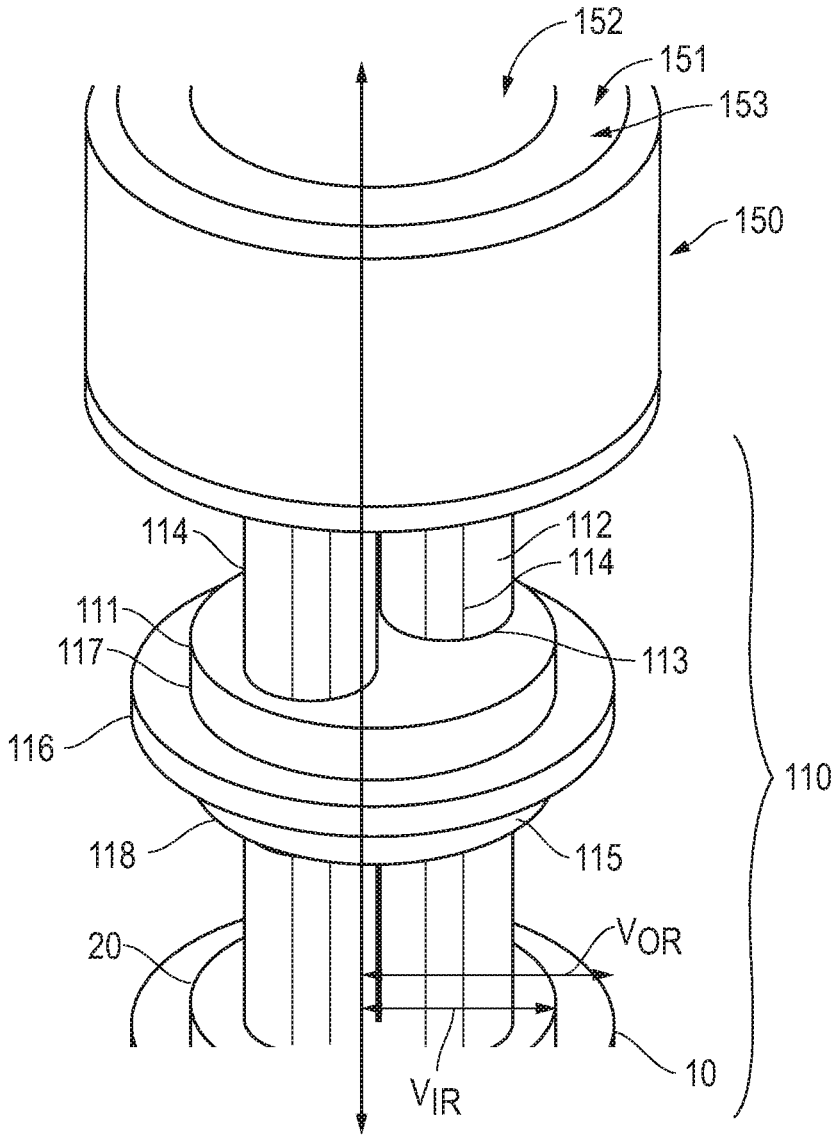
FIG. 2 illustrates an exploded view of a cap assembly according to an embodiment described herein.

FIG. 2 includes an exploded view of the cap assembly 100. According to particular embodiments and as shown in FIG. 2, the cap assembly 100 may include the rigid cap 150 and a stopper 110. According to certain embodiments, the stopper 110 may include a polymer body 111 and a tubular portion 112 that defines an internal passageway extending through a polymer body bore 113 of the polymer body 111 of the stopper 110. According to particular embodiments and as shown in FIG. 2, the polymer body 111 may be adapted to fit the opening 20 of the vessel 10. According to still other embodiments, the rigid cap 150 may be adapted to fit over the stopper 110 and onto the opening 20 of the vessel 10.

According to yet other embodiments and as shown in FIG. 2, the stopper 110 may include a substantially cylindrical section 115 and an annular flange 116 extending outward in the radial direction from the substantially cylindrical section 115. According to yet other embodiments, the cylindrical section 115 of the stopper 110 may include a top surface 117 and a bottom surface 118 and the tubular portion 112 may extend axially away from the top surface 117 and the bottom surface 118.

According to yet other embodiments and as shown in FIG. 2, the rigid cap 150 may include a radial flange 151 defining a central bore 152. According to still other embodiments, the rigid cap 150 may further include at least one annular axial flange 153 extending from a radial edge of the radial flange 151 and adapted to contact the exterior surface 22 of the opening 20 of the vessel 10. According to still other embodiments, the annular axial flange 153 may have a top surface 153*a*, a side surface 153*b*, and a bottom surface 153*c*.

According to yet other embodiments and as shown in FIG. 2, the stopper 110 may form an integral seal with the radial flange 151 of the rigid cap 150. According to still other embodiments, the stopper 110 may substantially fill the central bore 152 of the rigid cap 150.

Figure 3:
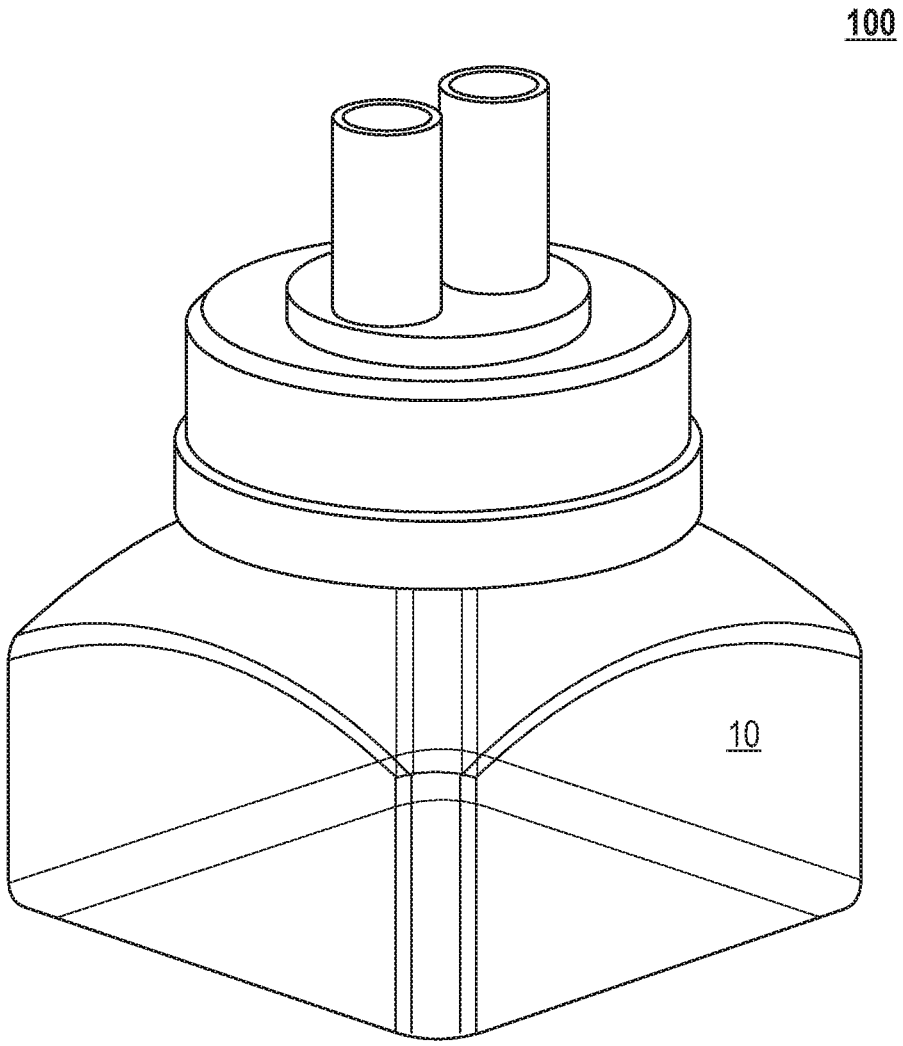
FIG. 3 illustrates a perspective view of an assembled cap assembly according to an embodiment described herein.

For purposes of further illustration, FIG. 3 shows a perspective view of an assembled cap assembly 100 according to an embodiment of the present disclosure.

Figure 4A:
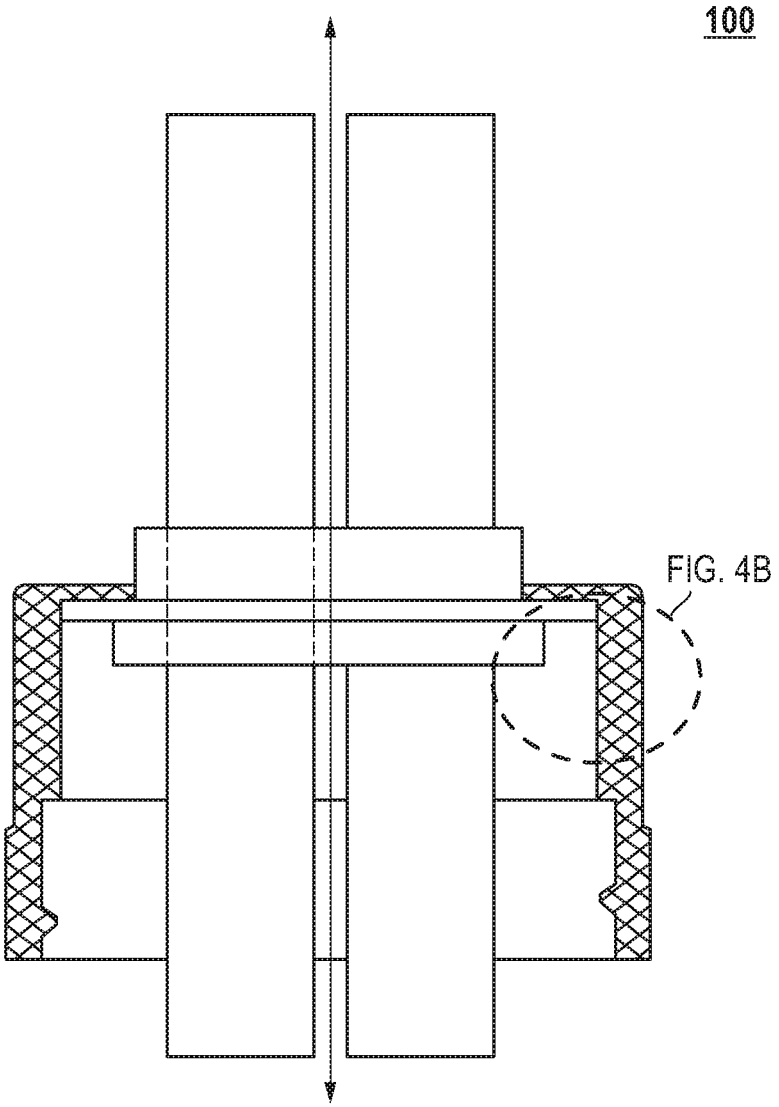
FIG. 4A illustrates a cross section of an assembled cap assembly of an embodiment described herein.

For purposes of further illustration, FIG. 4A illustrates a cross section of an assembled cap assembly 100 of an embodiment of the present disclosure.

Figure 4B:
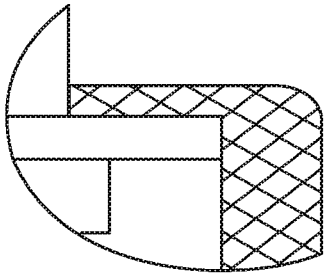
FIG. 4B illustrates a view of a portion of the cross section of an assembled cap assembly as seen in Circle A shown in FIG. 4A in accordance with an embodiment described herein.

For purposes of still further illustration, FIG. 4B illustrates a cross section of a portion of assembled cap assembly 100 as seen in Circle A of FIG. 4A.

According to yet other embodiments, the rigid cap 150 may be a molded piece or material. According to still other embodiments, the rigid cap 150 may be a single molded piece of material.

According to other embodiments, the rigid cap 150 may be attached to or integral with the stopper 110. According to still other embodiments, the rigid cap 150 may be adapted to engage the vessel 10 and provide a sealing force between the stopper 110 and the vessel 10 after engagement of the pressure based locking mechanism 160 with the vessel 10.

According to certain embodiments, the rigid cap 150 may be adapted to engage the vessel 10 and provide a particular sealing force between the stopper 110 and the vessel 10 after engagement of the pressure based locking mechanism 160 with the vessel 10. For example, sealing force created between the stopper 110 and the vessel 10 after engagement of the pressure based locking mechanism 160 with the vessel 10 may be not greater than about 200 lbs, such as, not greater than about 190 lbs or not greater than about 180 lbs or not greater than about 170 lbs even not greater than about 160 lbs. According to still other embodiments, the sealing force created between the stopper 110 and the vessel 10 after engagement of the pressure based locking mechanism 160 with the vessel 10 may be at least about 100 lbs, such as, at least about 110 lbs or at least about 120 lbs or at least about 130 lbs or even at least about 140 lbs. It will be appreciated that sealing force created between the stopper 110 and the vessel 10 after engagement of the pressure based locking mechanism 160 with the vessel 10 may be within a range between any of the values noted above. It will be further appreciated that sealing force created between the stopper 110 and the vessel 10 after engagement of the pressure based locking mechanism 160 with the vessel 10 may be any value between any of the values noted above.

According to still other embodiments, the rigid cap 150 may have a particular inner radius defining the central bore 152 $C_{IR}$. For example, the inner radius $C_{IR}$ of the rigid cap 150 may be at least about 5 mm, such as, at least about 10 mm or at least about 15 mm or at least about 20 mm or at least about 30 mm or even at least about 40 mm. According to still other embodiments, the inner radius $C_{IR}$ of the rigid cap 150 may be no greater than about 40 mm, such as, no greater than about 30 mm or no greater than about 20 mm or no greater than about 15 mm or no greater than about 10 mm or even no greater than about 7 mm. It will be appreciated that the inner radius $C_{IR}$ of the rigid cap 150 may be within a range between any of the values noted above. It will be further appreciated that the inner radius $C_m$ of the rigid cap 150 may be any value between any of the values noted above.

According to still other embodiments, the rigid cap 150 may have a particular outer radius defining the radial edge $C_{UR}$. For example, the outer radius $C_{UR}$ of the rigid cap 150 may be at least about 5 mm, such as, at least about 10 mm or at least about 15 mm or at least about 20 mm or at least about 30 mm or even at least about 40 mm. According to still other embodiments, the outer radius $C_{UR}$ of the rigid cap 150 may be no greater than about 40 mm, such as, no greater than about 30 mm or no greater than about 20 mm or no greater than about 15 mm or no greater than about 10 mm or even no greater than about 7 mm. It will be appreciated that the outer radius $C_{UR}$ of the rigid cap 150 may be within a range between any of the values noted above. It will be further appreciated that the outer radius $C_{UR}$ of the rigid cap 150 may be any value between any of the values noted above.

According to yet other embodiments, the annular axial flange 153 of the rigid cap 150 may have a particular length $C_L$. For example, the length $C_L$ of the annular axial flange 153 may be at least 5 mm, such as, at least 10 mm, at least 15 mm, at least 20 mm, at least 30 mm, at least 40 mm. According to yet other embodiments, the length $C_L$ of the annular axial flange 153 may be no greater than about 40 mm, such as, no greater than about 30 mm or no greater than about 20 mm or no greater than about 15 mm or no greater than about 10 mm or even no greater than about 7 mm. It will be appreciated that the length $C_L$ of the annular axial flange 153 may be within a range between any of the values noted above. It will be further appreciated that the length $C_L$ of the annular axial flange 153 may be any value between any of the values noted above.

According to certain embodiments, the rigid cap 150 may include a polymer material. According to other embodiments, the rigid cap 150 may include a thermoplastic elastomeric hydrocarbon block copolymer, a polyether-ester block co-polymer, a thermoplastic polyamide elastomer, a thermoplastic polyurethane elastomer, a thermoplastic polyolefin elastomer, a thermoplastic vulcanizate, an olefin-based co-polymer, an olefin-based ter-polymer, a polyolefin plastomer, or combinations thereof. According to still other embodiments, the rigid cap 150 may include a styrene based block copolymer, such as, styrene-butadiene, styrene-isoprene, or combinations thereof. According to still other embodiments, the rigid cap 150 may include a styrenic thermoplastic elastomers, such as, for example, a triblock styrenic block copolymers (SBC), styrene-butadiene-styrene (SBS), styrene-isoprene-styrene (SIS), styrene-ethylene butylene-styrene (SEBS), styrene-ethylene propylene-styrene (SEPS), styrene-ethylene-ethylene-butadiene-styrene (SEEBS), styrene-ethylene-ethylene-propylene-styrene (SEEPS), styrene-isoprene-butadiene-styrene (SIBS), or combinations thereof.

According to other embodiments, the rigid cap 150 may include a polyolefin polymer, such as, for example, a homopolymer, a copolymer, a terpolymer, an alloy, or any combination thereof formed from a monomer, such as, ethylene, propylene, butene, pentene, methyl pentene, hexene, octene, or any combination thereof. According to still other embodiments, the polyolefin polymer may include copolymers of ethylene with propylene or alpha-olefins or copolymers of polypropylene with ethylene or alpha-olefins made by metallocene or non-metallocene polymerization processes. According to yet other embodiments, the polyolefin polymer may include copolymers of ethylene with polar vinyl monomers such as acetate (EVA), acrylic acid (EAA), methyl acrylate (EMA), methyl methacrylate (EMMA), ethyl acrylate (EEA) and butyl acrylate (EBA). According to yet other embodiments, the polyolefin polymer can be a terpolymer of ethylene, maleic anhydride and acrylates. In yet another embodiment, the polyolefin polymer can be an ionomer of ethylene and acrylic acid or methacrylic acid. According to still other embodiments, the polyolefin may be a reactor grade thermoplastic polyolefin polymer. According to particular embodiments, the rigid cap 150 may include, but are not limited to, thermoplastic, thermosets, fluropolymers, and combinations thereof. Specific examples of suitable polymer material can be polyvinyldiene fluoride (PVDF). In the certain embodiments, at least one of the rigid cap 150 may be formed of a thermoplastic elastomer, silicone, or combinations thereof. According to yet other embodiments, the rigid cap 150 may include a polymer including at least one of polytetrafluoroethylene (PTFE), modified polytetrafluoroethylene (mPTFE), ethylene-tetrafluoroethylene (ETFE), perfluoroalkoxyethylene (PFA), tetrafluoroethylene-hexafluoropropylene (FEP), tetrafluoro-ethylene-perfluoro (methyl vinyl ether) (MFA), polyvinylidene fluoride (PVDF), ethylene-chlorotrifluoroethylene (ECTFE), polyimide (PI), polyamidimide (PAI), polyphenylene sulfide (PPS), polyethersulofone (PES), polyphenylene sulfone (PPSO2), liquid crystal polymers (LCP), polyetherketone (PEK), polyether ether ketones (PEEK), aromatic polyesters (Ekonol), of polyether-etherketone (PEEK), polyetherketone (PEK), liquid crystal polymer (LCP), polyimide (PA), polyoxymethylene (POM), polyethylene (PE)/UHMPE, polypropylene (PP), polystyrene, styrene butadiene copolymers, polyesters, polycarbonate, polyacrylonitriles, polyamides, styrenic block copolymers, ethylene vinyl alcohol copolymers, ethylene vinyl acetate copolymers, polyesters grafted with maleic anhydride, poly-vinylidene chloride, aliphatic polyketone, liquid crystalline polymers, ethylene methyl acrylate copolymer, ethylene-norbomene copolymers, polymethylpentene and ethylene acyrilic acid copoloymer, mixtures, copolymers and any combination thereof.

According to yet other embodiments, the rigid cap 150 may include a metal or metal alloy. According to still other embodiments, the metal may be aluminum, iron, tin, platinum, titanium, magnesium, alloys thereof, or may be a different metal. Further, the metal can include steel. According to yet other embodiments, the steel can include stainless steel, such as austenitic stainless steel. Moreover, the steel can include stainless steel comprising chrome, nickel, or a combination thereof.

According to yet other embodiments, the rigid cap 150 may include one or more additives. For example, the one or more additives can include a plasticizer, a catalyst, a silicone modifier, a silicon component, a stabilizer, a curing agent, a lubricant, a colorant, a filler, a blowing agent, another polymer as a minor component, or a combination thereof. In a particular embodiment, the plasticizer can include mineral oil.

According to certain embodiments, the stopper 110 may include a polymer material. According to other embodiments, the stopper 110 may include a thermoplastic elastomeric hydrocarbon block copolymer, a polyether-ester block co-polymer, a thermoplastic polyamide elastomer, a thermoplastic polyurethane elastomer, a thermoplastic polyolefin elastomer, a thermoplastic vulcanizate, an olefin-based copolymer, an olefin-based ter-polymer, a polyolefin plastomer, or combinations thereof. According to still other embodiments, the stopper 110 may include a styrene based block copolymer, such as, styrene-butadiene, styrene-isoprene, or combinations thereof. According to still other embodiments, the stopper 110 may include a styrenic thermoplastic elastomers, such as, for example, a triblock styrenic block copolymers (SBC), styrene-butadiene-styrene (SBS), styrene-isoprene-styrene (SIS), styrene-ethylene butylene-styrene (SEBS), styrene-ethylene propylene-styrene (SEPS), styrene-ethylene-ethylene-butadiene-styrene (SEEBS), styrene-ethylene-ethylene-propylene-styrene (SEEPS), styrene-isoprene-butadiene-styrene (SIBS), or combinations thereof.

According to other embodiments, the stopper 110 may include a polyolefin polymer, such as, for example, a homopolymer, a copolymer, a terpolymer, an alloy, or any combination thereof formed from a monomer, such as, ethylene, propylene, butene, pentene, methyl pentene, hexene, octene, or any combination thereof. According to still other embodiments, the polyolefin polymer may include copolymers of ethylene with propylene or alpha-olefins or copolymers of polypropylene with ethylene or alpha-olefins made by metallocene or non-metallocene polymerization processes. According to yet other embodiments, the polyolefin polymer may include copolymers of ethylene with polar vinyl monomers such as acetate (EVA), acrylic acid (EAA), methyl acrylate (EMA), methyl methacrylate (EMMA), ethyl acrylate (EEA) and butyl acrylate (EBA). According to yet other embodiments, the polyolefin polymer can be a terpolymer of ethylene, maleic anhydride and acrylates. In yet another embodiment, the polyolefin polymer can be an ionomer of ethylene and acrylic acid or methacrylic acid. According to still other embodiments, the polyolefin may be a reactor grade thermoplastic polyolefin polymer. According to particular embodiments, the stopper 110 may include, but are not limited to, thermoplastic, thermosets, fluropolymers, and combinations thereof. Specific examples of suitable polymer material can be polyvinyldiene fluoride (PVDF). In the certain embodiments, at least one of the stopper 110 may be formed of a thermoplastic elastomer, silicone, or combinations thereof. According to yet other embodiments, the stopper 110 may include a polymer including at least one of polytetrafluoroethylene (PTFE), modified polytetrafluoroethylene (mPTFE), ethylene-tetrafluoroethylene (ETFE), perfluoroalkoxyethylene (PFA), tetrafluoroethylene-hexafluoropropylene (FEP), tetrafluoro-ethylene-perfluoro (methyl vinyl ether) (MFA), polyvinylidene fluoride (PVDF), ethylene-chlorotrifluoroethylene (ECTFE), polyimide (PI), polyamidimide (PAI), polyphenylene sulfide (PPS), polyethersulofone (PES), polyphenylene sulfone (PPSO2), liquid crystal polymers (LCP), polyetherketone (PEK), polyether ether ketones (PEEK), aromatic polyesters (Ekonol), of polyether-etherketone (PEEK), polyetherketone (PEK), liquid crystal polymer (LCP), polyimide (PA), polyoxymethylene (POM), polyethylene (PE)/UHMPE, polypropylene (PP), polystyrene, styrene butadiene copolymers, polyesters, polycarbonate, polyacrylonitriles, polyamides, styrenic block copolymers, ethylene vinyl alcohol copolymers, ethylene vinyl acetate copolymers, polyesters grafted with maleic anhydride, poly-vinylidene chloride, aliphatic polyketone, liquid crystalline polymers, ethylene methyl acrylate copolymer, ethylene-norbomene copolymers, polymethylpentene and ethylene acyrilic acid copoloymer, mixtures, copolymers and any combination thereof.

According to yet other embodiments, the stopper 110 may include a metal or metal alloy. According to still other embodiments, the metal may be aluminum, iron, tin, platinum, titanium, magnesium, alloys thereof, or may be a different metal. Further, the metal can include steel. According to yet other embodiments, the steel can include stainless steel, such as austenitic stainless steel. Moreover, the steel can include stainless steel comprising chrome, nickel, or a combination thereof.

According to yet other embodiments, the stopper 110 may include one or more additives. For example, the one or more additives can include a plasticizer, a catalyst, a silicone modifier, a silicon component, a stabilizer, a curing agent, a lubricant, a colorant, a filler, a blowing agent, another polymer as a minor component, or a combination thereof. In a particular embodiment, the plasticizer can include mineral oil.

According to certain embodiments, the cylindrical section 115 of the polymer body 111 may have a particular upper radius $SU_R$ equal to the radius of the cylindrical section 115 above the annular flange 116. For example, the inner radius $SU_R$ of the cylindrical section 115 may be at least about 5 mm, such as, at least about 10 mm or at least about 15 mm or at least about 20 mm or at least about 30 mm or even at about least 40 mm. According to still other embodiments, the upper radius $SU_R$ of the cylindrical section 115 may be no greater than about 40 mm, such as, no greater than about 30 mm or no greater than about 20 mm or no greater than about 15 mm or no greater than about 10 mm or even no greater than about 7 mm. It will be appreciated that the upper radius $SU_R$ of the cylindrical section 115 may be within a range between any of the values noted above. It will be further appreciated that the upper radius $SU_R$ of the cylindrical section 115 may be any value between any of the values noted above.

According to yet other embodiments, the cylindrical section 115 of the polymer body 111 may have a particular lower radius $SL_R$ equal to the radius of the cylindrical section 115 below the annular flange 116. For example, the lower radius $SL_R$ of the cylindrical section 115 may be at least about 5 mm, such as, at least about 10 mm or at least about 15 mm or at least about 20 mm or at least about 30 mm or even at about least 40 mm. According to still other embodiments, the lower radius $SL_R$ of the cylindrical section 115 may be no greater than about 40 mm, such as, no greater than about 30 mm or no greater than about 20 mm or no greater than about 15 mm or no greater than about 10 mm or even no greater than about 7 mm. It will be appreciated that the lower radius $SL_R$ of the cylindrical section 115 may be within a range between any of the values noted above. It will be further appreciated that the lower radius $SL_R$ of the cylindrical section 115 may be any value between any of the values noted above.

According to still other embodiments, annular flange 116 of the polymer body 111 may have particular radius $SF_R$. For example, the radius $SF_R$ of the annular flange 116 may be at least about 5 mm, such as, at least about 10 mm or at least about 15 mm or at least about 20 mm or at least about 30 mm or even at least about 40 mm. According to yet other embodiments, the radius $SF_R$ of the annular flange 116 may be no greater than about 40 mm, such as, no greater than about 30 mm or no greater than about 20 mm or no greater than about 15 mm or no greater than about 10 mm or even no greater than about 7 mm. It will be appreciated that the radius $SF_R$ of the annular flange 116 may be within a range between any of the values noted above. It will be further appreciated that the radius $SF_R$ of the annular flange 116 may be any value between any of the values noted above.

According to yet other embodiments, the polymer body 111 may have a particular axial length $S_L$. For example, the axial length $S_L$ of the polymer body 111 may be at least about 5 mm, such as, at least about 10 mm or at least about 15 mm or at least about 20 mm or at least about 30 mm or even at least 40 mm. According to still other embodiments, the axial length $S_L$ of the polymer body 111 may be no greater than about 40 mm, such as, no greater than about 30 mm or no greater than about 20 mm or no greater than about 15 mm or no greater than about 10 mm or even no greater than about 7 mm. It will be appreciated that the axial length $S_L$ of the polymer body 111 may be within a range between any of the values noted above. It will be further appreciated that the axial length $S_L$ of the polymer body 111 may be any value between any of the values noted above.

According to certain embodiments, the polymer body 111 may include a polymer material. According to other embodiments, the polymer body 111 may include a thermoplastic elastomeric hydrocarbon block copolymer, a polyether-ester block co-polymer, a thermoplastic polyamide elastomer, a thermoplastic polyurethane elastomer, a thermoplastic polyolefin elastomer, a thermoplastic vulcanizate, an olefin-based co-polymer, an olefin-based ter-polymer, a polyolefin plastomer, or combinations thereof. According to still other embodiments, the polymer body 111 may include a styrene based block copolymer, such as, styrene-butadiene, styrene-isoprene, or combinations thereof. According to still other embodiments, the polymer body 111 may include a styrenic thermoplastic elastomers, such as, for example, a triblock styrenic block copolymers (SBC), styrene-butadiene-styrene (SBS), styrene-isoprene-styrene (SIS), styrene-ethylene butylene-styrene (SEBS), styrene-ethylene propylene-styrene (SEPS), styrene-ethylene-ethylene-butadiene-styrene (SEEBS), styrene-ethylene-ethylene-propylene-styrene (SEEPS), styrene-isoprene-butadiene-styrene (SIBS), or combinations thereof.

According to other embodiments, the polymer body 111 may include a polyolefin polymer, such as, for example, a homopolymer, a copolymer, a terpolymer, an alloy, or any combination thereof formed from a monomer, such as, ethylene, propylene, butene, pentene, methyl pentene, hexene, octene, or any combination thereof. According to still other embodiments, the polyolefin polymer may include copolymers of ethylene with propylene or alpha-olefins or copolymers of polypropylene with ethylene or alpha-olefins made by metallocene or non-metallocene polymerization processes. According to yet other embodiments, the polyolefin polymer may include copolymers of ethylene with polar vinyl monomers such as acetate (EVA), acrylic acid (EAA), methyl acrylate (EMA), methyl methacrylate (EMMA), ethyl acrylate (EEA) and butyl acrylate (EBA). According to yet other embodiments, the polyolefin polymer can be a terpolymer of ethylene, maleic anhydride and acrylates. In yet another embodiment, the polyolefin polymer can be an ionomer of ethylene and acrylic acid or methacrylic acid. According to still other embodiments, the polyolefin may be a reactor grade thermoplastic polyolefin polymer. According to particular embodiments, the polymer body 111 may include, but are not limited to, thermoplastic, thermosets, fluropolymers, and combinations thereof. Specific examples of suitable polymer material can be polyvinyldiene fluoride (PVDF). In the certain embodiments, at least one of the polymer body 111 may be formed of a thermoplastic elastomer, silicone, or combinations thereof. According to yet other embodiments, the polymer body 111 may include a polymer including at least one of polytetrafluoroethylene (PTFE), modified polytetrafluoroethylene (mPTFE), ethylene-tetrafluoroethylene (ETFE), perfluoroalkoxyethylene (PFA), tetrafluoroethylene-hexafluoropropylene (FEP), tetrafluoro-ethylene-perfluoro (methyl vinyl ether) (MFA), polyvinylidene fluoride (PVDF), ethylene-chlorotrifluoroethylene (ECTFE), polyimide (PI), polyamidimide (PAI), polyphenylene sulfide (PPS), polyethersulofone (PES), polyphenylene sulfone (PPSO2), liquid crystal polymers (LCP), polyetherketone (PEK), polyether ether ketones (PEEK), aromatic polyesters (Ekonol), of polyether-ether-ketone (PEEK), polyetherketone (PEK), liquid crystal polymer (LCP), polyamide (PA), polyoxymethylene (POM), polyethylene (PE)/UHMPE, polypropylene (PP), polystyrene, styrene butadiene copolymers, polyesters, polycarbonate, polyacrylonitriles, polyamides, styrenic block copolymers, ethylene vinyl alcohol copolymers, ethylene vinyl acetate copolymers, polyesters grafted with maleic anhydride, poly-vinylidene chloride, aliphatic polyketone, liquid crystalline polymers, ethylene methyl acrylate copolymer, ethylene-norbomene copolymers, polymethylpentene and ethylene acyrilic acid copoloymer, mixtures, copolymers and any combination thereof.

According to yet other embodiments, the polymer body 111 may include a metal or metal alloy. According to still other embodiments, the metal may be aluminum, iron, tin, platinum, titanium, magnesium, alloys thereof, or may be a different metal. Further, the metal can include steel. According to yet other embodiments, the steel can include stainless steel, such as austenitic stainless steel. Moreover, the steel can include stainless steel comprising chrome, nickel, or a combination thereof.

According to yet other embodiments, the polymer body 111 may include one or more additives. For example, the one or more additives can include a plasticizer, a catalyst, a silicone modifier, a silicon component, a stabilizer, a curing agent, a lubricant, a colorant, a filler, a blowing agent, another polymer as a minor component, or a combination thereof. In a particular embodiment, the plasticizer can include mineral oil.

According to particular embodiments, the tubular portion 112 of the stopper 110 may extend through the polymer body 111 at the polymer body bore 113. According to yet other embodiments, the tubular portion 112 may define an internal passageway extending through the polymer body 111. According to still other embodiments, the tubular portion 112 may extend axially away from the top surface 117 and the bottom surface 118 of the polymer body 111. According to other embodiments, the tubular portion 112 may extend into the vessel 10 through the opening 20.

According to still other embodiments, the tubular portion 112 may have a particular inner radius $T_{IR}$ measured from the center of the tubular portion 112 to an inner surface of the tubular portion 112. For example, the inner radius $T_{IR}$ of the tubular portion 112 may be at least about 5 mm, such as, at least about 10 mm or at least about 15 mm or at least about 20 mm or at least about 30 mm or at least about 40 mm. According to yet other embodiments, the inner radius $T_{IR}$ of the tubular portion 112 may be no greater than about 40 mm, such as, no greater than about 30 mm or no greater than about 20 mm or no greater than about 15 mm or no greater than about 10 mm or even no greater than about 7 mm. It will be appreciated that the inner radius $T_{IR}$ of the tubular portion 112 may be within a range between any of the values noted above. It will be further appreciated that the inner radius $T_{IR}$ of the tubular portion 112 may be any value between any of the values noted above.

According to still other embodiments, the tubular portion 112 may have a particular outer radius $T_{OR}$ measured from the center of the tubular portion 112 to an outer surface of the tubular portion 112. For example, the outer radius $T_{OR}$ of the tubular portion 112 may be at least about 5 mm, such as, at least about 10 mm or at least about 15 mm or at least about 20 mm or at least about 30 mm or at least about 40 mm. According to yet other embodiments, the outer radius $T_{IR}$ of the tubular portion 112 may be no greater than about 40 mm, such as, no greater than about 30 mm or no greater than about 20 mm or no greater than about 15 mm or no greater than about 10 mm or even no greater than about 7 mm. It will be appreciated that the outer radius $T_{OR}$ of the tubular portion 112 may be within a range between any of the values noted above. It will be further appreciated that the outer radius $T_{OR}$ of the tubular portion 112 may be any value between any of the values noted above.

According to certain embodiments, the tubular portion 112 may include a polymer material. According to other embodiments, the tubular portion 112 may include a thermoplastic elastomeric hydrocarbon block copolymer, a polyether-ester block co-polymer, a thermoplastic polyamide elastomer, a thermoplastic polyurethane elastomer, a thermoplastic polyolefin elastomer, a thermoplastic vulcanizate, an olefin-based co-polymer, an olefin-based terpolymer, a polyolefin plastomer, or combinations thereof. According to still other embodiments, the tubular portion 112 may include a styrene based block copolymer, such as, styrene-butadiene, styrene-isoprene, or combinations thereof. According to still other embodiments, the tubular portion 112 may include a styrenic thermoplastic elastomers, such as, for example, a triblock styrenic block copolymers (SBC), styrene-butadiene-styrene (SBS), styrene-isoprene-styrene (SIS), styrene-ethylene butylene-styrene (SEBS), styrene-ethylene propylene-styrene (SEPS), styrene-ethylene-ethylene-butadiene-styrene (SEEBS), styrene-ethylene-ethylene-propylene-styrene (SEEPS), styrene-isoprene-butadiene-styrene (SIBS), or combinations thereof.

According to other embodiments, the tubular portion 112 may include a polyolefin polymer, such as, for example, a homopolymer, a copolymer, a terpolymer, an alloy, or any combination thereof formed from a monomer, such as, ethylene, propylene, butene, pentene, methyl pentene, hexene, octene, or any combination thereof. According to still other embodiments, the polyolefin polymer may include copolymers of ethylene with propylene or alpha-olefins or copolymers of polypropylene with ethylene or alpha-olefins made by metallocene or non-metallocene polymerization processes. According to yet other embodiments, the polyolefin polymer may include copolymers of ethylene with polar vinyl monomers such as acetate (EVA), acrylic acid (EAA), methyl acrylate (EMA), methyl methacrylate (EMMA), ethyl acrylate (EEA) and butyl acrylate (EBA). According to yet other embodiments, the polyolefin polymer can be a terpolymer of ethylene, maleic anhydride and acrylates. In yet another embodiment, the polyolefin polymer can be an ionomer of ethylene and acrylic acid or methacrylic acid. According to still other embodiments, the polyolefin may be a reactor grade thermoplastic polyolefin polymer. According to particular embodiments, the tubular portion 112 may include, but are not limited to, thermoplastic, thermosets, fluropolymers, and combinations thereof. Specific examples of suitable polymer material can be polyvinyldiene fluoride (PVDF). In the certain embodiments, at least one of the tubular portion 112 may be formed of a thermoplastic elastomer, silicone, or combinations thereof. According to yet other embodiments, the tubular portion 112 may include a polymer including at least one of polytetrafluoroethylene (PTFE), modified polytetrafluoroethylene (mPTFE), ethylene-tetrafluoroethylene (ETFE), perfluoroalkoxyethylene (PFA), tetrafluoroethylene-hexafluoropropylene (FEP), tetrafluoro-ethylene-perfluoro (methyl vinyl ether) (MFA), polyvinylidene fluoride (PVDF), ethylene-chlorotrifluoroethylene (ECTFE), polyimide (PI), polyamidimide (PAI), polyphenylene sulfide (PPS), polyethersulofone (PES), polyphenylene sulfone (PPSO2), liquid crystal polymers (LCP), polyetherketone (PEK), polyether ether ketones (PEEK), aromatic polyesters (Ekonol), of polyether-ether-ketone (PEEK), polyetherketone (PEK), liquid crystal polymer (LCP), polyamide (PA), polyoxymethylene (POM), polyethylene (PE)/UHMPE, polypropylene (PP), polystyrene, styrene butadiene copolymers, polyesters, polycarbonate, polyacrylonitriles, polyamides, styrenic block copolymers, ethylene vinyl alcohol copolymers, ethylene vinyl acetate copolymers, polyesters grafted with maleic anhydride, poly-vinylidene chloride, aliphatic polyketone, liquid crystalline polymers, ethylene methyl acrylate copolymer, ethylene-norbomene copolymers, polymethylpentene and ethylene acyrilic acid copoloymer, mixtures, copolymers and any combination thereof.

According to yet other embodiments, the tubular portion 112 may include a metal or metal alloy. According to still other embodiments, the metal may be aluminum, iron, tin, platinum, titanium, magnesium, alloys thereof, or may be a different metal. Further, the metal can include steel. According to yet other embodiments, the steel can include stainless steel, such as austenitic stainless steel. Moreover, the steel can include stainless steel comprising chrome, nickel, or a combination thereof.

According to yet other embodiments, the tubular portion 112 may include one or more additives. For example, the one or more additives can include a plasticizer, a catalyst, a silicone modifier, a silicon component, a stabilizer, a curing agent, a lubricant, a colorant, a filler, a blowing agent, another polymer as a minor component, or a combination thereof. In a particular embodiment, the plasticizer can include mineral oil.

According to still other embodiments, the sidewall 40 may have a circular cross-sectional shape, a non-round cross-sectional shape, a polygonal cross-sectional shape, or an oval cross-sectional shape.

According to still other embodiments, the vessel 10 may have a central vertical axis and a particular inner radius $V_{IR}$ extending from the central vertical axis to the inner surface of the sidewall 40. For example, the inner radius $V_{IR}$ of the vessel 10 may be no greater than about 40 mm, such as, no greater than about 30 mm or no greater than about 20 mm or no greater than about 15 mm or no greater than about 10 mm or even no greater than about 7 mm. According to yet other embodiments, the inner radius $V_{IR}$ of the vessel 10 may be at least about 5 mm, such as, at least about 10 mm or at least about 15 mm or at least about 20 mm or at least about 30 mm or even at least about 40 mm. It will be appreciated that the inner radius $V_{IR}$ of the vessel 10 may be within a range between any of the values noted above. It will be further appreciated that the inner radius $V_{IR}$ of the vessel 10 may be any value between any of the values noted above.

According to still other embodiments, the vessel 10 may have a central vertical axis and a particular outer radius $V_{OR}$ extending from the central vertical axis to the outer surface of the sidewall 40. For example, the outer radius $V_{OR}$ of the vessel 10 may be no greater than about 40 mm, such as, no greater than about 30 mm or no greater than about 20 mm or no greater than about 15 mm or no greater than about 10 mm or even no greater than about 7 mm. According to yet other embodiments, the outer radius $V_{OR}$ of the vessel 10 may be at least about 5 mm, such as, at least about 10 mm or at least about 15 mm or at least about 20 mm or at least about 30 mm or even at least about 40 mm. It will be appreciated that the outer radius $V_{OR}$ of the vessel 10 may be within a range between any of the values noted above. It will be further appreciated that the outer radius $V_{OR}$ of the vessel 10 may be any value between any of the values noted above.

According to still other embodiments, the vessel 10 may have an axial length $V_L$ along a central vertical axis of the vessel 10. For example, the axial length $V_L$ of the vessel 10 may be no greater than about 40 mm, such as, no greater than about 30 mm or no greater than about 20 mm or no greater than about 15 mm or no greater than about 10 mm or even no greater than about 7 mm. According to yet other embodiments, the axial length $V_L$ of the vessel 10 may be at least about 5 mm, such as, at least about 10 mm or at least about 15 mm or at least about 20 mm or at least about 30 mm or even at least about 40 mm. It will be appreciated that the axial length $V_L$ of the vessel 10 may be within a range between any of the values noted above. It will be further appreciated that the axial length $V_L$ of the vessel 10 may be any value between any of the values noted above.

According to still other embodiments, the opening 20 of the vessel 10 may have a particular inner radius $VO_{IR}$ extending from the central vertical axis of the vessel 10 to the inner surface of the opening 20. For example, the inner radius $VO_{IR}$ of the opening 20 may be no greater than about 40 mm, such as, no greater than about 30 mm or no greater than about 20 mm or no greater than about 15 mm or no greater than about 10 mm or even no greater than about 7 mm. According to yet other embodiments, the inner radius $VO_{IR}$ of the opening 20 may be at least about 5 mm, such as, at least about 10 mm or at least about 15 mm or at least about 20 mm or at least about 30 mm or even at least about 40 mm. It will be appreciated that the inner radius $VO_{IR}$ of the opening 20 may be within a range between any of the values noted above. It will be further appreciated that the inner radius $VO_{IR}$ of the opening 20 may be any value between any of the values noted above.

According to still other embodiments, the opening 20 of the vessel 10 may have a particular outer radius $VO_{OR}$ extending from the central vertical axis of the vessel 10 to the outer surface of the opening 20. For example, the outer radius $VO_{OR}$ of the opening 20 may be no greater than about 40 mm, such as, no greater than about 30 mm or no greater than about 20 mm or no greater than about 15 mm or no greater than about 10 mm or even no greater than about 7 mm. According to yet other embodiments, the outer radius $VO_{OR}$ of the opening 20 may be at least about 5 mm, such as, at least about 10 mm or at least about 15 mm or at least about 20 mm or at least about 30 mm or even at least about 40 mm. It will be appreciated that the outer radius $VO_{OR}$ of the opening 20 may be within a range between any of the values noted above. It will be further appreciated that the outer radius $VO_{OR}$ of the opening 20 may be any value between any of the values noted above.

According to certain embodiments, the vessel 10 may be formed from any desired material, such as, for example, a metal material, a plastic material, a glass material, or combinations thereof. According to a particular embodiment, the vessel 10 may be formed from a pyrex material. According to still other embodiments, the vessel 10 may include any desired material, such as, for example, a metal material, a plastic material, a glass material, or combinations thereof. According to a particular embodiment, the vessel 10 may include a pyrex material. According to still other embodiments, the vessel 10 may consist essentially of any desired material, such as, for example, a metal material, a plastic material, a glass material, or combinations thereof. According to a particular embodiment, the vessel 10 may consist essentially of a pyrex material.

According to particular embodiments, the stopper 110, the polymer body 111, the tubular portion 112, the rigid cap 150 or any combination thereof may be formed as a single piece or may be formed as multiple pieces. According to yet other embodiments, the stopper 110, the polymer body 111, the tubular portion 112, the rigid cap 150 or any combination thereof may be a molded component. According to yet other embodiments, the stopper 110, the polymer body 111, the tubular portion 112, the rigid cap 150 or any combination thereof may be a single molded component forming the cap assembly 100. According to yet other embodiments, the stopper 110, the polymer body 111, the tubular portion 112, the rigid cap 150 or any combination thereof may be separate molded cap assembly 10 components forming the cap assembly 10 through over-molding or other methods known in the art.

In an embodiment, as shown best in FIG. 4 the polymer body 14 of the stopper 12 may form an integral seal 102 with at least one of the radial flange 62 or annular axial flange 68 of the cap 60 and may substantially fill the central bore 64. The annular flange 34 may contact above or below the central bore 64 in the axial direction while the substantially cylindrical piece 32 may substantially fill the central bore 64. In an embodiment, as shown in FIG. 4, the surface of the annular axial flange 68 or the radial flange 62 of the cap 60 is sealed to at least one of the substantially cylindrical piece 32 or annular flange 32 of the stopper 12 to form an integral seal 102 between the cap 60 and the stopper 12. In a number of embodiments, the seal may be formed by molding, use of an adhesive, welding, mechanical attachment, or may be sealed a different way.

According to yet other embodiments, the stopper 110, the polymer body 111, the tubular portion 112, the rigid cap 150 or any combination thereof may be able to withstand sterilization processes. According to yet other embodiments, the stopper 110, the polymer body 111, the tubular portion 112, the rigid cap 150 or any combination thereof may be able to be sterilized by any method envisioned, such as, for example any sterilization methods that include steam, gamma, ethylene oxide, E-beam techniques, combinations thereof, and the like. In a particular embodiment, the polymer or polymeric blend is sterilized by gamma irradiation. For instance, the polymer or polymeric blend may be gamma sterilized at between about 25 kGy to about 55 kGy. In a particular embodiment, the polymer or polymeric blend is sterilized by steam sterilization. In an exemplary embodiment, the polymer or polymeric blend is heat-resistant to steam sterilization at temperatures up to about 130° C. for a time of up to about 45 minutes. In an embodiment, the polymer or polymeric blend is heat resistant to steam sterilization at temperatures of up to about 135° C. for a time of up to about 15 minutes.

According to certain embodiments, the stopper 110, the polymer body 111, the tubular portion 112, the rigid cap 150 or any combination thereof may be weldable, meaning that any of the stopper 110, the polymer body 111, the tubular portion 112, the rigid cap 150 or any combination thereof may be welded together. Notably, "welding" refers to welding two portions of the stopper 110, the polymer body 111, the tubular portion 112, the rigid cap 150 or any combination thereof together. Further, welding may include flat seals as well as circumferential seals for tubing applications. Energy is typically applied with parameters sufficient to yield a seal that withstands a seal integrity pressure test of about 30 psi air pressure for about 30 minutes under dry and wet conditions. Any other welding/sealing methods can be envisioned, for example, welding by heat, vibration, ultrasonic, infared, radiofrequency (RF), combinations thereof, and the like. In an embodiment, the cap assembly 10 or its components may be hermetically sealed to each other.

According to certain embodiments, the materials forming the stopper 110, the polymer body 111, the tubular portion 112, the rigid cap 150 or any combination thereof may advantageously exhibit desired properties for low temperature applications. For example, the materials forming the stopper 110, the polymer body 111, the tubular portion 112, the rigid cap 150 or any combination thereof may advantageously have low temperature performance, such as a cold temperature brittleness point of less than about −80° C., such as less than about −90° C., or even as low as less than about −110° C., as measured by ASTM D746. In a more particular embodiment, the materials forming the stopper 110, the polymer body 111, the tubular portion 112, the rigid cap 150 or any combination thereof may have a low temperature flexibility at about −80° C., as measured by ASTM D380.

According to certain embodiments, the materials forming the stopper 110, the polymer body 111, the tubular portion 112, the rigid cap 150 or any combination thereof may have desirable tube wear characteristics, such as, minimal spallation (internal) and fouling (external). In particular, spallation results in the generation of particles and debris in the fluid path and fouling results in gumminess and tackiness of the pump head. In a particular embodiment, the materials forming the stopper 110, the polymer body 111, the tubular portion 112, the rigid cap 150 or any combination may have a spallation and fouling of less than about 1.0% weight loss when tested using a L/S 17. Cole-Parmer peristaltic standard pump head. Further, the pump life has a dataset that has minimal statistical variation as indicated by standard deviation of less than about 10% of the data mean or average. In an embodiment, the materials forming the stopper 110, the polymer body 111, the tubular portion 112, the rigid cap 150 or any combination may have a volumetric flow rate reduction of less than 50%, such as less than about 30% of the initial starting value.

According to certain embodiments, the materials forming the stopper 110, the polymer body 111, the tubular portion 112, the rigid cap 150 or any combination thereof may have further desirable physical and mechanical properties. For instance, the materials forming the stopper 110, the polymer body 111, the tubular portion 112, the rigid cap 150 or any combination thereof may be flexible, kink-resistant and appear transparent or at least translucent. For instance, the materials forming the stopper 110, the polymer body 111, the tubular portion 112, the rigid cap 150 or any combination thereof may have a light transmission greater than about 2%, or greater than about 5% in the visible light wavelength range. In particular, the materials forming the stopper 110, the polymer body 111, the tubular portion 112, the rigid cap 150 or any combination thereof may have desirable flexibility and substantial clarity or translucency. For instance, the materials forming the stopper 110, the polymer body 111, the tubular portion 112, the rigid cap 150 or any combination thereof may advantageously produce low durometer articles. For example, an article having a Shore A durometer of between about 35 and about 75, such as between about 55 to about 70 having desirable mechanical properties may be formed. Such properties are indicative of a flexible material.

In addition to desirable hardness, the materials forming the stopper 110, the polymer body 111, the tubular portion 112, the rigid cap 150 or any combination thereof may have advantageous physical properties, such as, a balance of any one or more of the properties of hardness, flexibility, surface lubricity, pump life, spallation, fouling, tensile strength, elongation, Shore A hardness, gamma resistance, weld strength, and seal integrity to an optimum level.

In an embodiment, the materials forming the stopper 110, the polymer body 111, the tubular portion 112, the rigid cap 150 or any combination thereof may have desirable heat stability properties. In a particular embodiment, the materials forming the stopper 110, the polymer body 111, the tubular portion 112, the rigid cap 150 or any combination thereof may have one more of the following heat resistance properties such as a higher burst resistance, a higher softening point, and/or a higher autoclaving temperature compared to currently available commercial products.

Figure 5A:
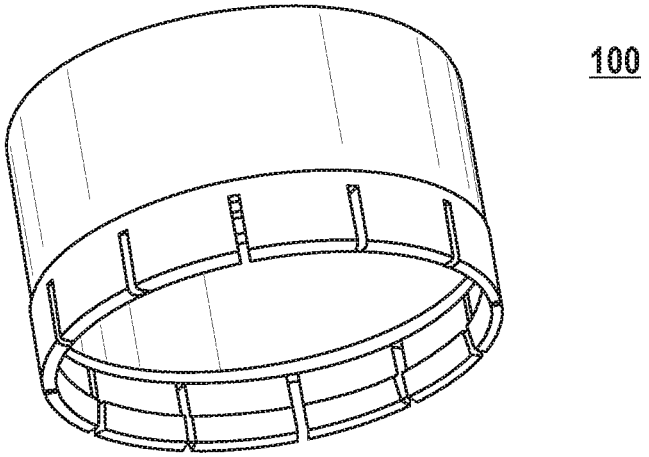
FIG. 5A illustrates an example design of a rigid cap for use in a cap assembly according to an embodiment described herein.

For purposes of further illustration, FIG. 5A shows an illustration of an example design of a rigid cap 250 for use in a cap assembly 100 according to an embodiment described herein. According to the particular embodiment and as shown in FIG. 5A, the rigid cap 250 may include a pressure based locking (or snap connecting) mechanism 260 and a tamper evident feature 270.

Figure 5B:
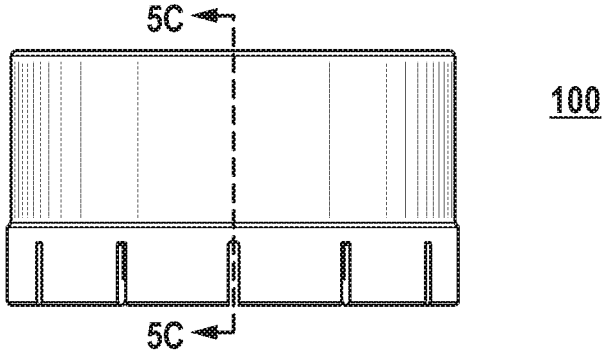
FIG. 5B illustrates a perspective view of the rigid cap of FIG. 5A according to an embodiment described herein.

For purposes of further illustration, FIG. 5B illustrates a perspective view of the rigid cap 250 of FIG. 5A according to an embodiment described herein. According to the particular embodiment and as shown in FIG. 5B, the rigid cap 250 may include a pressure based locking (or snap connecting) mechanism 260 and a tamper evident feature 270.

Figure 5C:
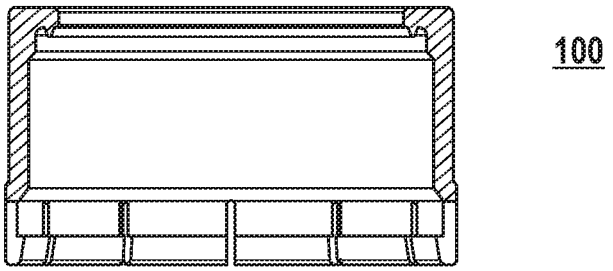
FIG. 5C illustrates a cross sectional view of the rigid cap shown in FIGS. 5A and 5B along the cross sectional line A-A shown in FIG. 5B.

For purposes of still further illustration, FIG. 5C illustrates a cross sectional view of the rigid cap 250 shown in FIGS. 5A and 5A along the cross sectional line A-A shown in FIG. 5B. According to the particular embodiment and as shown in FIGS. 5A and 5B, the rigid cap 250 may include a pressure based locking (or snap connecting) mechanism 260 and a tamper evident feature 270.

Many different aspects and embodiments are possible. Some of those aspects and embodiments are described below. After reading this specification, skilled artisans will appreciate that those aspects and embodiments are only illustrative and do not limit the scope of the present invention.

Embodiment 1

A cap assembly for closing an opening in a vessel, the cap assembly comprising: a stopper comprising a polymer body adapted to fit an opening of a vessel, wherein the stopper further comprises a tubular portion defining an internal passageway extending through the polymer body; and a rigid cap adapted to fit over the stopper and onto the vessel, wherein the cap comprises: a pressure based locking mechanism; and a tamper evident feature.

Embodiment 2

A method for forming a cap assembly, the method comprising: forming a stopper including an polymer body adapted to fit an opening of a vessel, the stopper also including a tubular portion which defines an internal passageway extending through the elastomer body; and forming a rigid cap attached to and integral with the stopper, wherein the rigid cap is adapted to fit over the stopper and onto the vessel, wherein the cap comprises: a pressure based locking mechanism; and a tamper evident feature.

Embodiment 3

The cap assembly or method of any one of embodiments 1 and 2, wherein the pressure based locking mechanism is adapted to engage the vessel under a unidirectional engagement force.

Embodiment 4

The cap assembly or method of any one of embodiments 1 and 2, wherein the pressure based locking mechanism, when engaged with the vessel, provides a sealing pressure between the stopper and the vessel.

Embodiment 5

The cap assembly or method of any one of embodiments 1 and 2, wherein the unidirectional engagement force is not greater than about 50 lbs.

Embodiment 6

The cap assembly or method of any one of embodiments 1 and 2, wherein the direct engagement pressure is at least about 10 lbs.

Embodiment 7

The cap assembly or method of any one of embodiments 1 and 2, wherein the sealing pressure between the stopper and the vessel is at least about 200 lbs.

Embodiment 8

The cap assembly or method of any one of embodiments 1 and 2, wherein the sealing pressure between the stopper and the vessel is not greater than about 100 lbs.

Embodiment 9

The cap assembly or method of any one of embodiments 1 and 2, wherein tamper evident feature is adapted to show an alteration in its physical appearance upon any attempt to remove the cap assembly after engagement of the pressure based locking mechanism with the vessel.

Embodiment 10

The cap assembly or method of any one of embodiments 1 and 2, wherein the stopper comprises a substantially cylindrical section and a annular flange extending outward in the radial direction from the substantially cylindrical section.

Embodiment 11

The cap assembly or method of any one of embodiments 1 and 2, wherein the stopper substantially cylindrical section comprises a top surface and a bottom surface and the tubular portion extends axially away from the top surface and the bottom surface.

Embodiment 12

The cap assembly or method of any one of embodiments 1 and 2, wherein the cap comprises a radial flange defining a central bore, and at least one annular axial flange extending from a radial edge of the radial flange and adapted to contact the opening of the vessel.

Embodiment 13

The cap assembly or method of any one of embodiments 1 and 2, wherein the stopper forms an integral seal with the radial flange of the cap and substantially fills the central bore.

Embodiment 14

The cap assembly or method of any one of embodiments 1 and 2, wherein the cap comprises a locking mechanism capable of locking and sealing the cap to the vessel, the locking mechanism comprising a catch or a latch.

Embodiment 15

The cap assembly or method of any one of embodiments 1 and 2, wherein at least one of stopper and the cap is a molded piece.

Embodiment 16

The cap assembly or method of any one of embodiments 1 and 2, wherein the stopper and the cap are a single molded piece.

Embodiment 17

The cap assembly or method of any one of embodiments 1 and 2, wherein a surface of the annular axial flange or the radial flange of the cap is sealed to at least one of the substantially cylindrical section or annular flange of the stopper.

Embodiment 18

The cap assembly or method of any one of embodiments 1 and 2, wherein the assembly further comprises a vessel having a bottom, a sidewall extending from the bottom, wherein the sidewall comprises an opening opposite the bottom for accepting the cap.

Embodiment 19

The cap assembly or method of any one of embodiments 1 and 2, wherein the vessel comprises glass, plastic, metal, or pyrex.

Embodiment 20

The cap assembly or method of any one of embodiments 1 and 2, wherein the cap comprises an polymer.

Embodiment 21

The cap assembly or method of any one of embodiments 1 and 2, wherein the stopper and the cap are formed from the same polymer.

Embodiment 22

The cap assembly or method of any one of embodiments 1 and 2, wherein the stopper and the cap are formed from different polymer.

Embodiment 23

The cap assembly or method of any one of embodiments 1 and 2, wherein the stopper is formed from a polymer comprising fluoropolymer, a thermoplastic polymer, etc., elastomer comprising a thermoplastic elastomeric hydrocarbon block copolymer, a polyether-ester block co-polymer, a thermoplastic polyamide elastomer, a thermoplastic polyurethane elastomer, a thermoplastic polyolefin elastomer, a thermoplastic vulcanizate, an olefin-based co-polymer, an olefin-based ter-polymer, a polyolefin plastomer, or combinations thereof.

Embodiment 24

The cap assembly or method of any one of embodiments 1 and 2, wherein the cap is formed from a polymer comprising fluoropolymer, a thermoplastic polymer, metal, a thermoplastic elastomer comprising a thermoplastic elastomeric hydrocarbon block copolymer, a polyether-ester block co-polymer, a thermoplastic polyamide elastomer, a thermoplastic polyurethane elastomer, a thermoplastic polyolefin elastomer, a thermoplastic vulcanizate, an olefin-based co-polymer, an olefin-based ter-polymer, a polyolefin plastomer, or combinations thereof.

Embodiment 25

The cap assembly or method of any one of embodiments 1 and 2, wherein at least one of the stopper or cap further comprises a silicon compound.

Embodiment 26

The cap assembly or method of any one of embodiments 1 and 2, wherein the tubular portion has an outer diameter smaller than the outer diameter of the annular flange of the stopper.

Embodiment 27

The cap assembly or method of any one of embodiments 1 and 2, wherein annular flange of the stopper has an outer diameter that is less than the inner diameter of the cap.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

Note that not all of the activities described above in the general description or the examples are required, that a portion of a specific activity may not be required, and that one or more further activities may be performed in addition to those described. Still further, the order in which activities are listed are not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed:

1. A cap assembly for closing an opening in a vessel, the cap assembly comprising:

a stopper comprising a polymer body adapted to fit an opening of a vessel, wherein the stopper further comprises more than one non-concentric tubular portions each defining an internal passageway extending through the polymer body, wherein at least one of the tubular portions and the polymer body are a single molded component, wherein at least one of the tubular portions extends axially away from a top surface and a bottom surface of the polymer body; and a rigid cap adapted to fit over the stopper and onto the vessel, wherein the cap comprises:

a radial flange defining a central bore, wherein the stopper comprises a cylindrical top surface that extends beyond an uppermost top surface of the cap in the axial direction along a central axis;

a snap connecting pressure based locking mechanism comprising an inwardly directed flange comprising a tapered top edge and a substantially horizontal bottom edge; and a tamper evident feature adapted to show an alteration in its physical appearance comprising cracking, breakage, or deformation upon any attempt to remove the cap assembly after engagement of the pressure based locking mechanism with the vessel, wherein the pressure based locking mechanism is adapted to engage the vessel under a unidirectional engagement force of not greater than about 50 lbs.

2. The cap assembly of claim 1, wherein the pressure based locking mechanism, when engaged with the vessel, provides a sealing pressure between the stopper and the vessel.

3. The cap assembly of claim 1, wherein the direct engagement pressure is at least about 10 lbs.

4. The cap assembly of claim 1, wherein the sealing pressure between the stopper and the vessel is at least about 200 lbs.

5. The cap assembly of claim 1, wherein the sealing pressure between the stopper and the vessel is not greater than about 100 lbs.

6. The cap assembly of claim 1, wherein the stopper comprises a substantially cylindrical section and an annular flange extending outward in the radial direction from the substantially cylindrical section.

7. The cap assembly of claim 1, wherein the stopper substantially cylindrical section comprises a top surface and a bottom surface and the tubular portion extends axially away from the top surface and the bottom surface.

8. The cap assembly of claim 1, wherein the stopper forms an integral seal with the cap.

9. The cap assembly of claim 1, wherein the cap comprises a locking mechanism capable of locking and sealing the cap to the vessel, the locking mechanism comprising a catch or a latch.

10. The cap assembly of claim 1, wherein at least one of stopper and the cap is a molded piece.

11. A method for forming a cap assembly, the method comprising:

forming a stopper including a polymer body adapted to fit an opening of a vessel, the stopper also including more than one non-concentric tubular portions, each of which defines an internal passageway extending through the elastomer body, wherein at least one of the tubular portions and the polymer body are a single molded component, wherein at least one of the tubular portions extends axially away from a top surface and a bottom surface of the polymer body; and forming a rigid cap adapted to fit over the stopper and onto the vessel, wherein the cap comprises:

a radial flange defining a central bore, wherein the stopper comprises a cylindrical top surface that extends beyond an uppermost top surface of the cap in the axial direction along a central axis;

a snap connecting pressure based locking mechanism comprising an inwardly directed flange comprising a tapered top edge and a substantially horizontal bottom edge; and a tamper evident feature adapted to show an alteration in its physical appearance comprising cracking, breakage, or deformation upon any attempt to remove the cap assembly after engagement of the pressure based locking mechanism with the vessel, wherein the pressure based locking mechanism is adapted to engage the vessel under a unidirectional engagement force of not greater than about 50 lbs.

12. The method of claim 11, wherein the pressure based locking mechanism, when engaged with the vessel, provides a sealing pressure between the stopper and the vessel.

13. The method of claim 11, wherein the direct engagement pressure is at least about 10 lbs.

14. The method of claim 11, wherein the sealing pressure between the stopper and the vessel is at least about 200 lbs.

* * * * *